United States Patent [19]

Segan et al.

[11] Patent Number: 4,547,635

[45] Date of Patent: Oct. 15, 1985

[54] SQUEEZE SWITCH PARTICULARLY ADAPTED FOR USE WITH STUFFED TOYS

[75] Inventors: Marc C. Segan; Sayre A. Swarztrauber, both of New York; Neil K. Patterson, Brooklyn, all of N.Y.

[73] Assignee: R. Dakin, South San Francisco, Calif.

[21] Appl. No.: 571,191

[22] Filed: Jan. 16, 1984

[51] Int. Cl.[4] ..... H01H 35/00

[52] U.S. Cl. ..... 200/52 R; 200/85 R

[58] Field of Search ..... 200/5 A, 52 R, 61.2, 200/61.21, 85 R, 85 A, 86 A, 293, 302.1

[56] References Cited

U.S. PATENT DOCUMENTS

| | | | |
|---|---|---|---|
| 3,959,610 | 5/1976 | Finnegan et al. | 200/5 A |
| 3,996,429 | 12/1976 | Chu et al. | 200/5 A |
| 4,046,975 | 9/1977 | Seeger, Jr. | 200/5 A |

*Primary Examiner*—J. R. Scott

*Attorney, Agent, or Firm*—Pennie & Edmonds

[57] ABSTRACT

The invention relates to a squeeze switch assembly or switch housing which is particularly adapted for inclusion in a stuffed toy that has some type of electrical mechanism within it. A flat layer of resilient material is attached on one surface to a switch plate and on the other surface to a cover plate. The cover plate and the layer of resilient material have an aperture passing through them so that the apertures are coaxial. The cover plate is attached to and seals a container which contains a switch to and optionally the electrical mechanism. A plunger passes through the apertures in the layer of resilient material and the cover plate and slides when the switch plate is moved toward the cover plate so that the sliding action of the plunger actuates the switch thereby energizing the electrical mechanism.

14 Claims, 3 Drawing Figures

SQUEEZE SWITCH PARTICULARLY ADAPTED FOR USE WITH STUFFED TOYS

BACKGROUND OF THE INVENTION

The present invention relates to a squeeze switch assembly or switch housing which is particularly suitable for use in stuffed toys and which is constructed so that environmental elements, such as dust or stuffing, are prevented from entering the switch assembly.

Stuffed toys have always been popular, but as technology developed, children's expectations changed so that there arose a demand for toys which had more than merely a pleasant appearance. Toys were thus developed which were able to move or make sounds, for example. In order to make a stuffed toy visually appealing and pleasant to the sense of touch, the electrical mechanism used to make the stuffed toy move or make sounds was inserted into the toy and hidden at least partially within the stuffing. The switching means used to activate the electrical mechanism was frequently placed at or near the surface of the toy so that it would be easily accessible; See for example U.S. Pat. Nos. 2,633,667, 3,080,679, 3,162,980, 3,384,074, and 3,685,200. This surface placement of the switching means, however, detracted from the overall appearance of the toy.

Another type of switch assembly is shown in U.S. Pat. No. 3,755,960 which comprises a slidably mounted spring loaded push button located at the surface of the doll, which when pressed, moves a lever which acts upon an actuator button that operates a talking mechanism. In this switch assembly, although the actuator button is located within the body of the doll, the mechanism is not sealed within a separate container to protect the mechanism from the doll's stuffing. After continued use of the toy, the stuffing of the toy could enter both the switch and the electrical mechanism causing either or both to malfunction.

SUMMARY OF THE INVENTION

The invention relates to a squeeze switch assembly or switch housing which is particularly adapted for inclusion in a stuffed toy or novelty item that has some type of electrical mechanism within it.

In a preferred embodiment of the invention, a flat layer of resilient material is attached on one surface to a switch plate and on the other surface to a cover plate. The cover plate and the layer of resilient material each have an aperture passing through them so that the apertures are coaxial. The cover plate is attached to and seals a container which contains an electrical mechanism. A plunger passes through the apertures in the layer of resilient material and the cover plate and slides when the switch plate is moved toward the cover plate so that the sliding action of the plunger activates the electrical mechanism.

An advantage of the present invention is that the construction of the switch assembly utilizes the layer of resilient material, which acts as the spring in a conventional push button switch, to form a switch assembly which is completely sealed and into which environmental elements cannot enter. Thus, when the switch assembly is placed into a stuffed toy, the sealed construction of the switch assembly does not allow the stuffing to interfere with the operation of the electrical mechanism located within the assembly.

Another advantage is that because the switch assembly is sealed, the entire assembly may be inserted into a stuffed toy so that the assembly is not only not visible, but it is also in a position so that it may not be easily felt when the toy is squeezed.

Another advantage is that construction of the switch assembly allows the plunger to slide when the switch plate and the cover plate are pushed towards each other at any point. Thus, when the assembly is placed within a stuffed toy near its center and the toy is squeezed, the switch plate and the cover plate approach each other at some point thereby causing the plunger to slide and the electrical mechanism to be activated.

BRIEF DESCRIPTION OF THE DRAWINGS

These and other objects, features, and advantages of the invention will be more readily apparent from the following description of the invention in which.

DESCRIPTION OF THE PREFERRED EMBODIMENT

Figure 1:
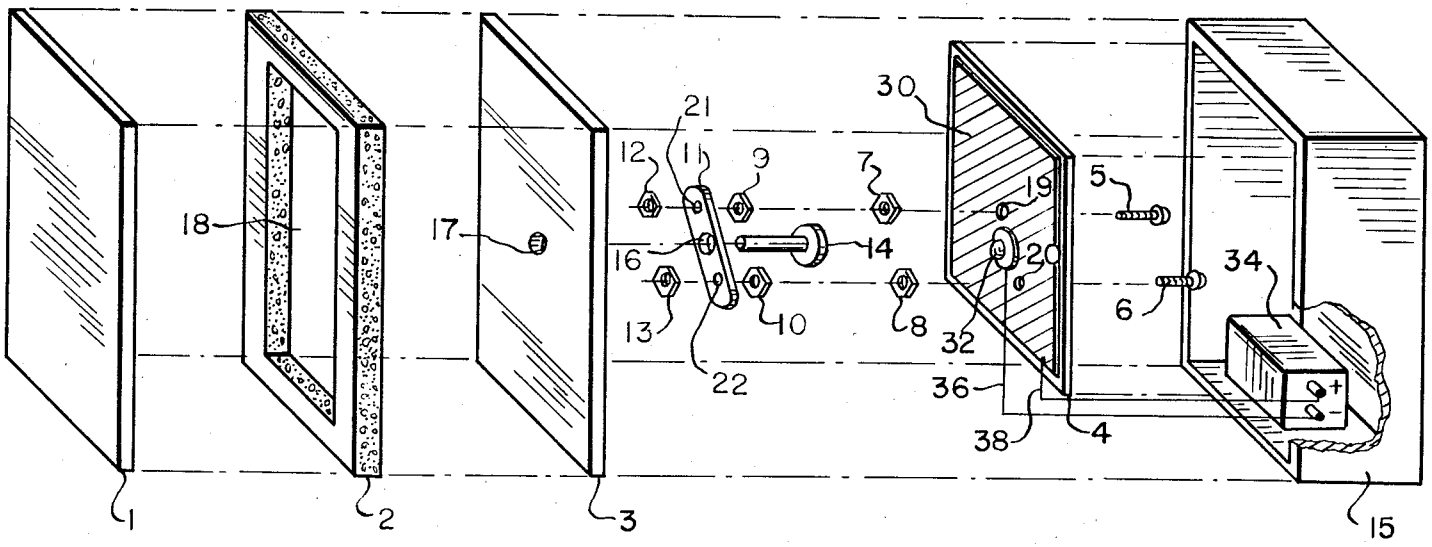
FIG. 1 is an exploded view of a first embodiment of the switch assembly of the invention.
Figure 2:
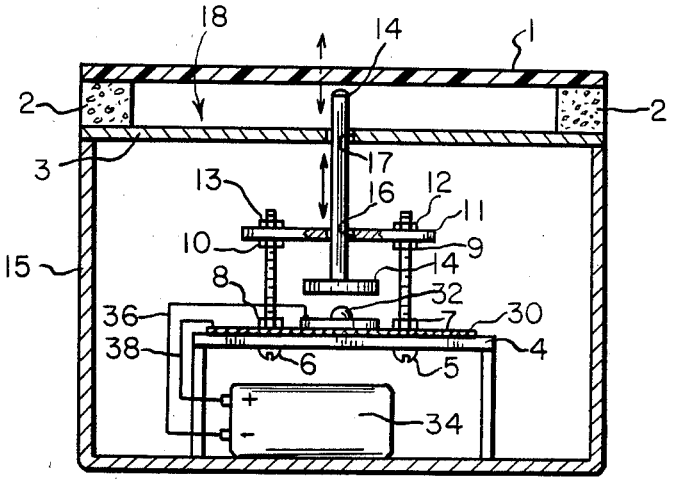
FIG. 2 is a cross-sectional view of the first embodiment of the switch assembly of the invention.

As shown in FIGS. 1 and 2, the switch assembly comprises a switch plate 1, a resilient layer 2, a cover plate 3, a board 4, two screws 5, 6, six nuts 7, 8, 9, 10, 12, 13, a sleeve 11, a plunger 14, and a container 15.

Switch plate 1 is a thin plate of rigid material such as plastic or metal. The switch plate illustrated is flat and rectangular in shape so as to conform to the shape of container 15. It will be apparent to those skilled in the art that other shapes of switch plates, e.g. convex, concave or round, as well as other container shapes may be employed without departing from the concept of the invention or the scope of the claims.

Resilient layer 2 is attached to switch plate 1 and is composed of a resilient material, such as foam rubber or sponge, which has a memory in that when it is compressed, it returns to its original size and shape after the pressure has been removed. Resilient layer 2 has approximately the same rectangular shape as switch plate 1 although the thickness is such that upon manually applying a moderate amount of pressure, resilient layer 2 easily compresses to at least about half its original thickness. Resilient layer 2 contains an aperture 18 which passes completely through resilient layer 2 and is of a size such that it is completely covered by switch plate 1.

Cover plate 3 is composed of the same material and is approximately the same size as switch plate 1 and is attached to the face of resilient layer 2 that is not attached to switch plate 1. Cover plate 3 contains an aperture 17 which passes completely through cover plate 3 and is coaxial with aperture 18 in resilient layer 2. The aperture 17 is of a size so that it is completely enclosed by resilient layer 2.

Board 4 is used as a mount for an electrical circuit 30 and switch 32. Electrical circuit 30 generates sound when the switch 32 is actuated when the switch assembly is squeezed as is explained in detail below. Board 4 contains two holes 19, 20 through which screws 5 and 6 pass. Nuts 7 and 8 fasten screws 5 and 6 to board 4.

Sleeve 11 contains three holes 16, 21, 22 and is attached to screws 5 and 6 by nuts 9, 10, 12 and 13.

Plunger 14 passes through plunger hole 16 in sleeve 11 and is of a size and shape so that it slides through sleeve 11 and so that one end of plunger 14 passes through aperture 17 in cover plate 3 and aperture 18 in resilient layer 2 and touches switch plate 1. Plunger 14 has a cross-sectional "T" shape so that it can slide but cannot pass completely through plunger hole 16 in sleeve 11. Sleeve 11 is attached to board 4 by nuts 9, 10, 12, 13 and screws 5 and 6 which pass through holes 21, 22 so that sleeve 11 is a fixed distance away from board 4 and so that there is sufficient space for plunger 14 to slide through sleeve 11 a distance equal to the maximum compression of resilient layer 2.

It will be appreciated that the electrical circuit 30 and switch 32 mounted on board 4 may have a variety of characteristics and can be activated by the motion of plunger 14 and its equivalents in a number of different ways. For example, switch 32 may be a momentary contact switch which operates so that the sliding action of plunger 14 causes contact members (not shown) in switch 32 to close resulting in the operation of the electrical circuit 30. The switch 32 may be an on/off switch which operates so that when the contact members are successively closed, the electrical circuit 30 is alternatively turned on and off. Alternatively, if the electrical circuit 30 is used to generate sound, switch 32 it may be a stepping switch which operates so that when the contact members are closed the volume of the sound is adjusted so that a first closing of the contact members results in the circuit 30 being turned on and sound at a predetermined level is generated. Successive closings of the contact members result in a reduction in the volume of the sound generated until after a certain number of closings of the contact members, the electrical circuit 30 is turned off completely. The next closing results in the electrical circuit being turned on again so that the cycle is repeated.

It is also possible to design the electrical circuit to generate a musical tune when the contact members are closed. The electrical circuit generating the musical tune may be designed to turn off automatically when the tune has been completely played or when the contact members have been closed again, whichever occurs first.

Alternatively, the switch may be designed so that the sliding action of plunger 14 causes the contact members of switch 32 to open. Electrical circuit 30 would operate upon the opening of the contact members, in a similar manner as detailed above for the case where the action of the plunger causes the contact members to close.

Container 15 is attached to board 4 and covers plate 3 so that board 4, sleeve 11, plunger 14, screws 5, 6 nuts 7, 8, 9, 10, 12, 13 electrical circuit 30 and switch 32 are completely enclosed.

Figure 3:
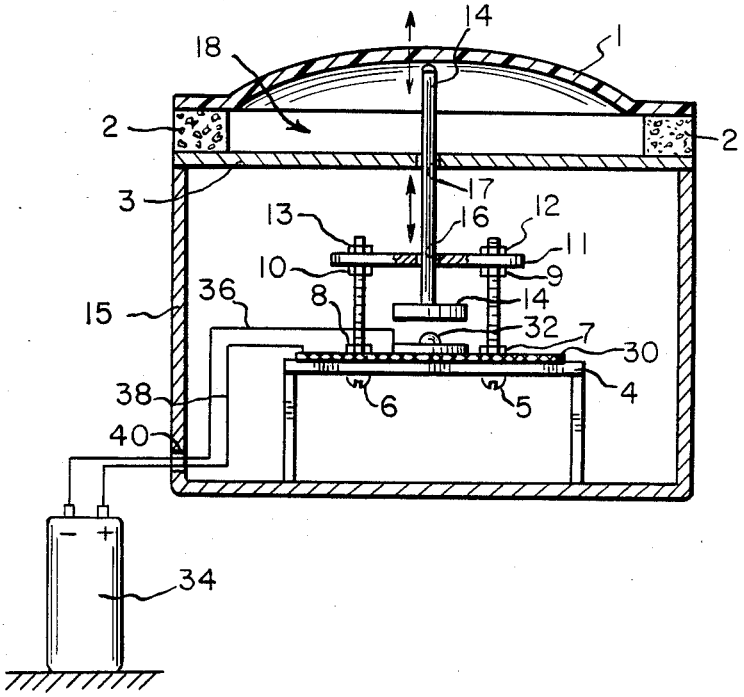
FIG. 3 is a cross-sectional view of a second embodiment of the switch assembly of the invention.

A source of electrical power, such as a battery 34, is electrically connected to the electrical circuit by a pair of wires 36 and 38 and may be located either inside or outside of sealed container 15. In FIGS. 1 and 2, battery 34 is shown to be located within sealed container 15, while in FIG. 3, battery 34 is shown to be located outside of sealed container 15. In FIG. 3, wires 36 and 38 which connect electrical circuit 30 and switch 32 to battery 34 pass through a hole 40 in container 15. It is advantageous to place the battery outside sealed container 15 so that battery replacement is facilitated.

To further simplify battery replacement, the switch assembly is inserted into the toy so that it may be removed easily. Illustratively, the switch assembly is placed into a zippered pouch which is sewn into the toy so that the pouch is within the toy near its center but the zipper is sewn to the toy at its surface. In this configuration, the battery may be replaced simply by opening the zippered pouch and disconnecting and then removing the battery.

In operation, when switch plate 1 is depressed, resilient layer 2 is compressed and switch plate 1 approaches cover plate 3. The movement of switch plate 1 causes a first end of plunger 14 to come in contact with switch plate 1 thereby causing plunger 14 to slide through plunger hole 16 in sleeve 11. The second end of plunger 14 then engages and actuates switch 34 mounted on board 4. The actuating of switch 34 causes electrical circuit 30 to be electrically connected to battery 34 by wires 36 and 38 thereby energizing electrical circuit 30.

The switch assembly is of an overall size and shape so that it can be inserted into a stuffed toy and so that when it is inserted, it cannot be felt through the stuffing. Illustratively, the edges and corners of switch plate 1, cover plate 3 and container 15 are rounded, and switch plate 1 is 4.0 cm. in length and 6.0 cm. in height and the assembly is 3.0 cm. in width. Alternatively, as shown in FIG. 3, switch plate 1 is in the shape of a dome instead of a flat plate. This dome shape results in giving switch plate 1 a greater surface area thus permitting it to be more sensitive to pressures exerted when the toy is squeezed at any angle. In this embodiment, the length of piston 14 must be such that when the switch assembly is squeezed, dome shaped switch plate 1 causes piston 14 to slide a sufficient distance to actuate switch 32.

When the electrical circuit 30 mounted to board 4 is used to produce sounds, it is advantageous to construct container 15 so that there is an array of small holes or a single aperture covered by screening to facilitate the propagation of the sound produced. Alternatively, the electrical circuit is placed within the sealed switch assembly while the sound producing element (or speaker) is electrically connected to the electrical circuit but is located outside the switch assembly.

There are numerous possibilities for the shape of the stuffed toy or novelty item. A few examples are: pillows, animals or human figures.

Likewise, there are numerous possibilities for the type of sound that may be produced by the electrical circuit. A few examples are: music, speech or, if the stuffed toy is a representation of an animal, characteristic animal noises, such as a bark for a stuffed dog.

While the invention has been described in conjunction with specific embodiments, it is evident that numerous alternatives, modifications, and variations within the scope of the claimed invention will be apparent to those skilled in the art in light of the foregoing description.

What is claimed is:

1. In a stuffed novelty item having an electrically driven apparatus, a source of electrical energy, a switch electrically connecting said electrically driven apparatus and said source of electrical energy, and a switch housing disposed within said novelty item, said switch housing comprising:

a first plate;

a layer of resilient material attached to one face of said first plate;

a second plate attached to said layer of resilient material, said second plate having an aperture which passes therethrough from one face to an opposite face of said second plate;

a container in sealed attachment to the face of said second plate opposite the face to which said resilient material is attached, said container enclosing said switch; and switch actuating means operating so that squeezing of said novelty item moves said first plate toward said second plate compressing said resilient material and causing said switch to be actuated thereby energizing said electrical driven apparatus.

2. The stuffed novelty item of claim 1 wherein said first plate is in the shape of a dome and is in sealed attachment to said layer of resilient material so that the concave surface of said first plate faces said layer of resilient material.

3. The stuffed novelty item of claim 1 wherein said layer of resilient material has an aperture passing therethrough from a first face of said layer of resilient material attached to said first plate to a second face of said layer of resilient material attached to said second plate, said aperture in said layer of resilient material being coaxial with said aperture of said second plate, said aperture in said layer of resilient material being completely covered by said first plate, said second plate being in sealed attachment to said second face of said layer of resilient material.

4. The stuffed novelty item of claim 3 wherein said switch actuating means is at least partially positioned within said apertures in said layer of resilient material and said second plate.

5. The stuffed novelty item of claim 1 wherein said first plate is comprised of a rigid material.

6. The stuffed novelty item of claim 1 wherein said electrically driven apparatus is located within said container.

7. In a stuffed novelty item having an electrically driven apparatus, a source of electrical energy, a switch electrically connected to said electrically driven apparatus and said source of electrical energy, and a switch housing disposed within said novelty item, said switch housing comprising:

a first plate;

a layer of resilient material with an aperture passing there through from a first face to an opposite second face, said first face in sealed attachment to one face of said first plate such that said aperture is completely covered by said first plate;

a second plate with an aperture passing there through from one face to an opposite face in sealed attachment to said second face of said layer of resilient material such that said aperture in said second plate and said aperture in said resilient material are coaxial;

a container in sealed attachment to the face of said second plate opposite the face to which said resilient material is attached, said container completely enclosing said aperture in said second plate; and a plunger having a first end and a second end slideably attached within said container, said first end of said plunger extending through said aperture in said second plate and through said aperture in said layer of resilient material toward said first plate, said plunger positioned within said container such that the squeezing of said novelty item moves said first plate towards said second plate compressing said resilient material thereby engaging said first end of said plunger causing said plunger to slide to cause said switch to be actuated thereby energizing said electrically driven apparatus.

8. The stuffed novelty item of claim 7 wherein said first plate is in the shape of a dome and is in sealed attachement to said layer of resilient material so that the concave surface of said first plate faces said layer of resilient material.

9. The stuffed novelty item of claim 7 wherein said electrically driven apparatus is located within said container.

10. An environmentally protected switch housing enclosing a switch comprising:

a first plate;

a layer of resilient material with an aperture passing therethrough from a first face to an opposite second face, said first face in sealed attachment to one face of said first plate such that said aperture is completely covered by said first plate;

a second plate with an aperture passing there through from one face to an opposite face in sealed attachment to said second face of said layer of resilient material such that said aperture in said second plate and said aperture in said resilient material are coaxial;

a container in sealed attachment to the face of said second plate opposite the face to which said resilient material is attached, said container completely enclosing said aperture in said second plate; and a plunger having a first end and a second end slideably attached within said container, said first end of said plunger extending through said aperture in said second plate and through said aperture in said layer of resilient material toward said first plate, said plunger positioned within said container such that when said first plate is moved toward said second plate compressing said resilient material, said first end of said plunger is engaged by said first plate thereby causing said plunger to slide so that said second end of said plunger causes said switch to be actuated.

11. The environmentally protected switch housing of claim 10 wherein the edges and corners of the first plate, the second plate and the container are rounded.

12. The environmentally protected switch housing of claim 11 wherein the size of the faces of the first plate is at least the same as that of the faces of the flat layer of resilient material and the size of the faces of the second plate is at least the same as that of the faces of the flat layer of resilient material.

13. The environmentally protected switch housing of claim 12 wherein said first plate is in the shape of a dome and is in sealed attachment to said layer of resilient material so that the concave surface of said first plate faces said layer of resilient material.

14. The environmentally protected switch housing of claim 13 wherein the size of said switch housing is such that said housing may be inserted into a stuffed novelty item.

* * * * *

UNITED STATES PATENT AND TRADEMARK OFFICE

CERTIFICATE OF CORRECTION

PATENT NO. : 4,547,635

DATED : Oct. 15, 1985

INVENTOR(S) : Marc C. Segan, et al.

It is certified that error appears in the above-identified patent and that said Letters Patent is hereby corrected as shown below:

In the Abstract, at line 10, after "switch" and before "and", delete "to".

Signed and Sealed this

*Fourteenth* Day of *January 1986*

[SEAL]

*Attest:*

DONALD J. QUIGG

*Attesting Officer*

*Commissioner of Patents and Trademarks*